US005906082A

United States Patent [19]

Counihan

[11] Patent Number: 5,906,082

[45] Date of Patent: May 25, 1999

[54] RESILIENT FLOORING SYSTEM

[76] Inventor: James Counihan, 50 Griffin Mill Rd., Piedmont, S.C. 29673

[21] Appl. No.: 08/923,313

[22] Filed: Sep. 4, 1997

[51] Int. Cl.[6] ..... E04F 15/16

[52] U.S. Cl. ..... 52/403.1; 52/480; 52/586.1; 52/591.5; 52/591.4

[58] Field of Search ..... 52/403.1, 480, 52/586.1, 591.5, 591.4

[56] References Cited

U.S. PATENT DOCUMENTS

| | | | |
|---|---|---|---|
| 274,354 | 3/1883 | McCarthy et al. | 52/591.4 |
| 726,506 | 4/1903 | Capen | 52/591.4 |
| 1,832,397 | 11/1931 | Hultquist | 52/586.1 |
| 1,986,739 | 1/1935 | Mitte | 52/591.4 |
| 3,122,073 | 2/1964 | Masse | 52/403.1 |
| 3,271,916 | 9/1966 | Omholt | 52/403.1 |
| 3,436,888 | 4/1969 | Ottosson | 52/480 |
| 3,511,001 | 5/1970 | Morgan, Jr. | 52/480 |
| 3,553,919 | 1/1971 | Omholt | 52/480 |
| 3,554,850 | 1/1971 | Kuhle | 52/591.4 |
| 4,170,859 | 10/1979 | Counihan | 52/586.1 |
| 4,589,243 | 5/1986 | Abendroth | 52/403.1 |
| 4,648,592 | 3/1987 | Harinishi | 52/480 |
| 4,759,164 | 7/1988 | Abendroth | 52/403.1 |
| 4,879,856 | 11/1989 | Jones | 52/403.1 |
| 4,890,434 | 1/1990 | Niese | 52/403.1 |
| 4,910,936 | 3/1990 | Abendroth et al. | 52/480 |
| 4,930,280 | 6/1990 | Abendroth | 52/403.1 |
| 5,016,413 | 5/1991 | Counihan | 52/403.1 |
| 5,369,927 | 12/1994 | Counihan | 52/403.1 |
| 5,388,380 | 2/1995 | Niese | 52/403.1 |
| 5,497,590 | 3/1996 | Counihan | 52/403.1 |
| 5,540,025 | 7/1996 | Takehara et al. | 52/403.1 |
| 5,609,000 | 3/1997 | Niese | 52/403.1 |
| 5,647,183 | 7/1997 | Counihan | 52/480 |
| 5,727,354 | 3/1998 | Clement | 52/480 |

*Primary Examiner*—Christopher Kent
*Assistant Examiner*—Phi Dieu Tran A
*Attorney, Agent, or Firm*—Henry S. Jaudon; Cort Flint

[57] ABSTRACT

A resilient flooring system for assembly on a base surface to provide a resilient floor. The system includes a plurality of multi-layer planar panels having a flooring layer and a support layer. The flooring layer consist of a plurality of multi-length hardwood shorts secured with the support layer. The panels include an exposed side and end where the edge areas of the support layer are uncovered by the flooring layer. Also, there is provided a covered side and end where the flooring layer overlays the edges of a side and end of the support layer. Shoulders are formed in each end of the panel members. Securing strips having opposed flanges are arranged over the base floor to extend over the shoulder at each panel end to secure the panels in position. Resilient strips are provided between the base floor and the flooring panels to allow limited vertical movement.

22 Claims, 5 Drawing Sheets

RESILIENT FLOORING SYSTEM

BACKGROUND OF THE INVENTION

The invention relates to a surface resilient flooring system constructed over a non-resilient base surface. The invention also relates to a flooring panel constructed for use with the referred to resilient flooring system which includes a multi-layer panel having a flooring layer assembled on and supported by a support layer.

Various arrangements for forming flooring, both resilient and non-resilient over base surfaces are known. U.S. Pat. No. 4,170,859 discloses a flooring structure which includes flooring panel units having grooves formed in opposing ends of the flooring members to receive flanges of securing strips. U.S. Pat. No. 5,253,464 is directed to a similar structure and uses resilient strips to support the flooring above the base floor. U.S. Pat. No. 3,436,888 shows a flooring system using flooring shorts arranged in a herringbone pattern.

It is noted none of the prior art flooring systems utilize multi-layer flooring panels which are supported from the base surface with resilient materials and which are secured in a manner to allow limited vertical motion.

Accordingly it is an object of the invention to provide a resilient flooring system comprised of planar multi-layer panels having a flooring layer formed of a plurality of hardwood shorts and a support layer formed of a unitary substantially non-resilient member.

Another object of the invention is the provision of multi-layer flooring panels having selected flooring patterns formed by arranging the hardwood shorts longitudinally of the support layer in various lengths.

Another object of the invention is the provision of multi-layer flooring panels formed with a flooring surface arranged in a herringbone pattern.

Another object of the invention is the provision of multi-layer flooring panels with a parquet flooring surface.

Another object of the invention is to provide a resilient flooring system which utilizes planar multi-layer flooring patterns.

Another object of the invention is to provide a resilient flooring system utilizing flooring panels arranged in horizontal stabilized positions but having the capability of limited vertical movement.

Another object of the invention is to provide a securing system which stabilizes flooring panels of a resilient flooring system in longitudinal and transverse directions.

SUMMARY OF THE INVENTION

The instant invention is directed to a resilient flooring system formed of planar multi-layer panels arranged side by side and end to end over a base surface. The panels are supported above the base surface with spaced resilient strips although a resilient layer would be equally effective.

The panels comprise a flooring layer which consists of a plurality of hardwood shorts of varying length and selected widths secured with a unitary substantially non resilient plywood panel. The panels range in size between 6" to 2' in width, about 12" to 4' in length. The shorts are generally between 0.75" to 2.25" in width. They preferably are formed tongue and groove and are intermeshed as secured with the plywood sheet. The shorts are arranged transversely cross the plywood sheet or alternatively diagonally in a herring bone pattern or transversely and longitudinally in a parquet pattern.

The flooring layer is formed to be slightly larger than the support layer and is arranged in an offset position to extend beyond or to overlay an end and a side of the plywood sheet. Also, the opposite end and side are left uncovered by the flooring layer. This allows the overlying portions of the flooring layer to cover the exposed surfaces of an adjacent plywood sheet when the flooring panels are assembled.

Opposed ends of the flooring panels are formed to have transversely extending shoulders across their width. A first shoulder is formed across the exposed end of the plywood sheet while the other shoulder is formed beneath the flooring layer and across the opposed end of the plywood panel. By providing for the flooring layer to overlay an end portion of the support layer, support is given to the flooring system where the panels join and dead spots are eliminated.

Securing members or fastening strips are secured with and arranged across the base surface at spaced intervals. Each fastening strip includes oppositely directed flanges. The flanges are designed to overlay opposed shoulders of adjacent flooring panels when positioned over the base surface. Normally there is a clearance within the shoulder of about ⅛" to allow limited vertical movement of the flooring panels relative to the overlaying flanges.

A plurality of positioning strips which are secured with and arranged over the base surface transversely of the fastening strips are also provided. The positioning strips are adapted to engage edges of selected sides of spaced panel members to eliminate transverse movement of the panel. Normally the fastening strips are engaged only with edges of the support layer.

Spacers of resilient material are secured with at least one of these engaged side edges of the support layer and the associated edge of the flooring layer to allow expansion due to moisture. Spacers may also be secured with selected opposed edges at opposed ends of selected flooring panels if it is found to be desirable.

The fastening strips and the positioning strips may be secured with the base floor in a permanent manner or in a removable manner.

DESCRIPTION OF THE PREFERRED EMBODIMENT

Figure 1:
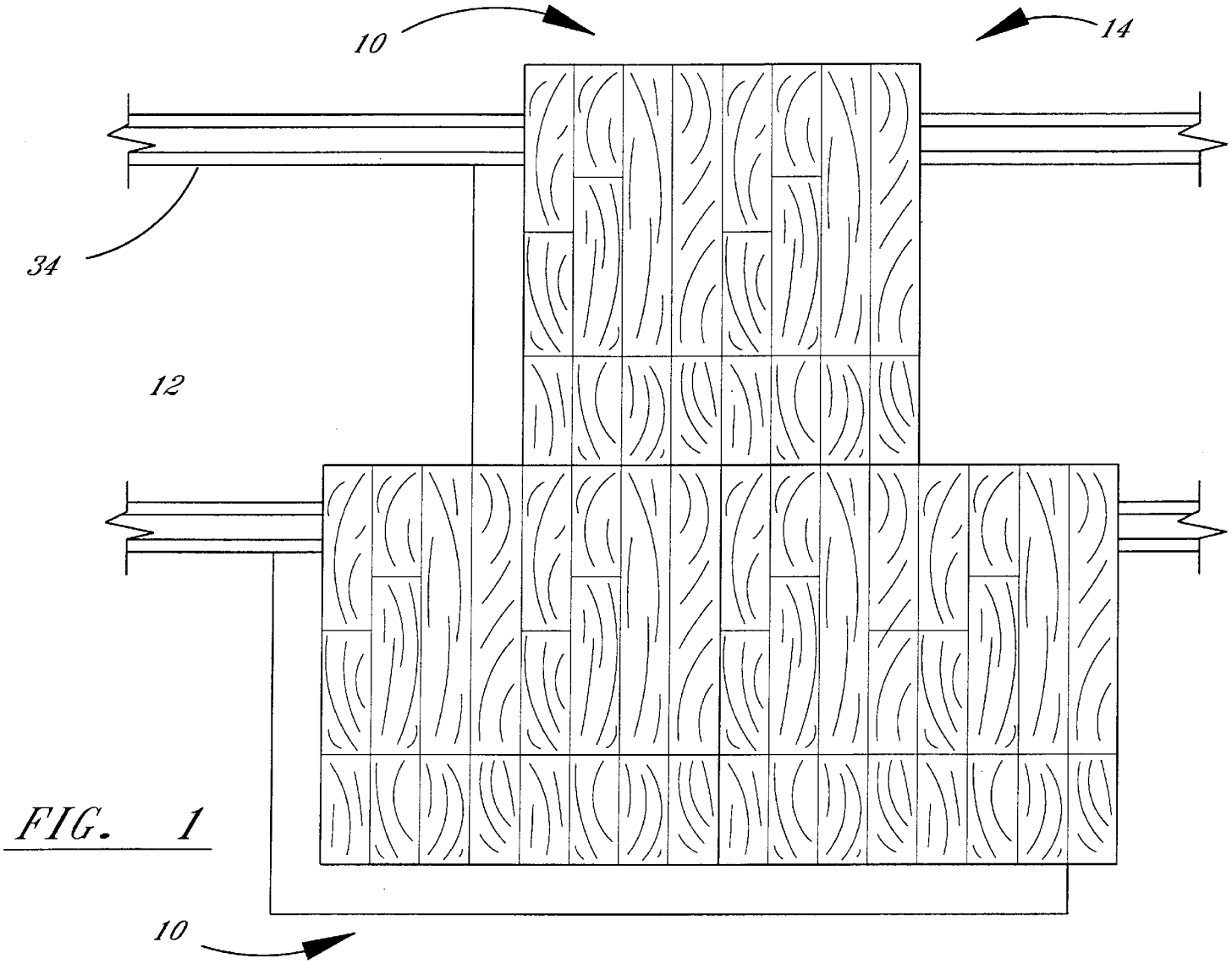
FIG. 1 is a sectional perspective view of the resilient flooring structure of the invention.

Turning now to FIG. 1, a general arrangement of flooring system A is shown. The flooring system consists of a plurality of flooring panels 10 arranged over and secured with base floor 12 by securing strips 34. Flooring panels 10, at one side of strip 34, have their upper ends tucked under a flange of the securing strip while the flooring panel on the opposite end of the securing strip have ends, which are disposed beneath the flooring surface, tucked under an opposed flange. The flooring surfaces of the panels on one end of the securing strip overlay and cover the securing strip as will be hereinafter described. Alternate rows of flooring panels 10 are arranged in an offset manner. Flooring panels 10 are arranged side by side and end to end in the manner shown in FIG. 1 over the entire area of base floor 12.

Figure 2:
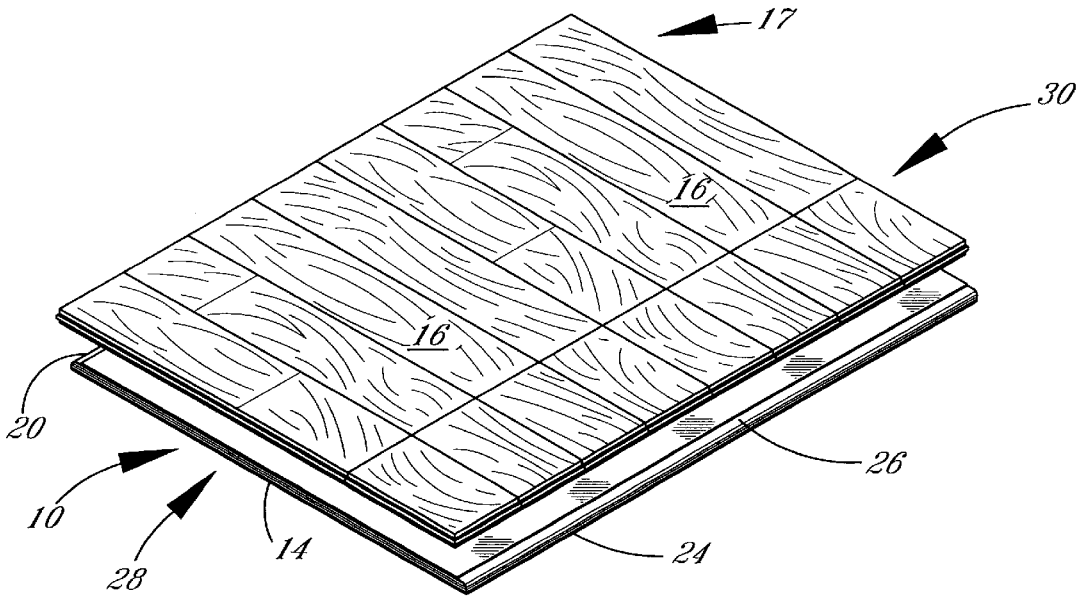
FIG. 2 is a perspective view of a flooring panel according to a first embodiment of the invention.

As best shown in FIG. 2, each flooring panel comprises a support layer 14 formed of ½", ¾ or 1" plywood sheets which are formed in selected dimensions ranging between 6" to 24" wide and 12" to 48" long. Secured to the upper surface of each plywood sheet are a plurality of hardwood shorts 16 which form flooring surface 17. The shorts are usually 2.25" wide and between 0.75" to 1" in thickness. Their length may vary between 16" and 36" which lengths may be uniform or varying over each flooring panel. Shorts 16 are secured to support surface 14 preferably by gluing, however other methods such as nailing may be used.

Figure 3:
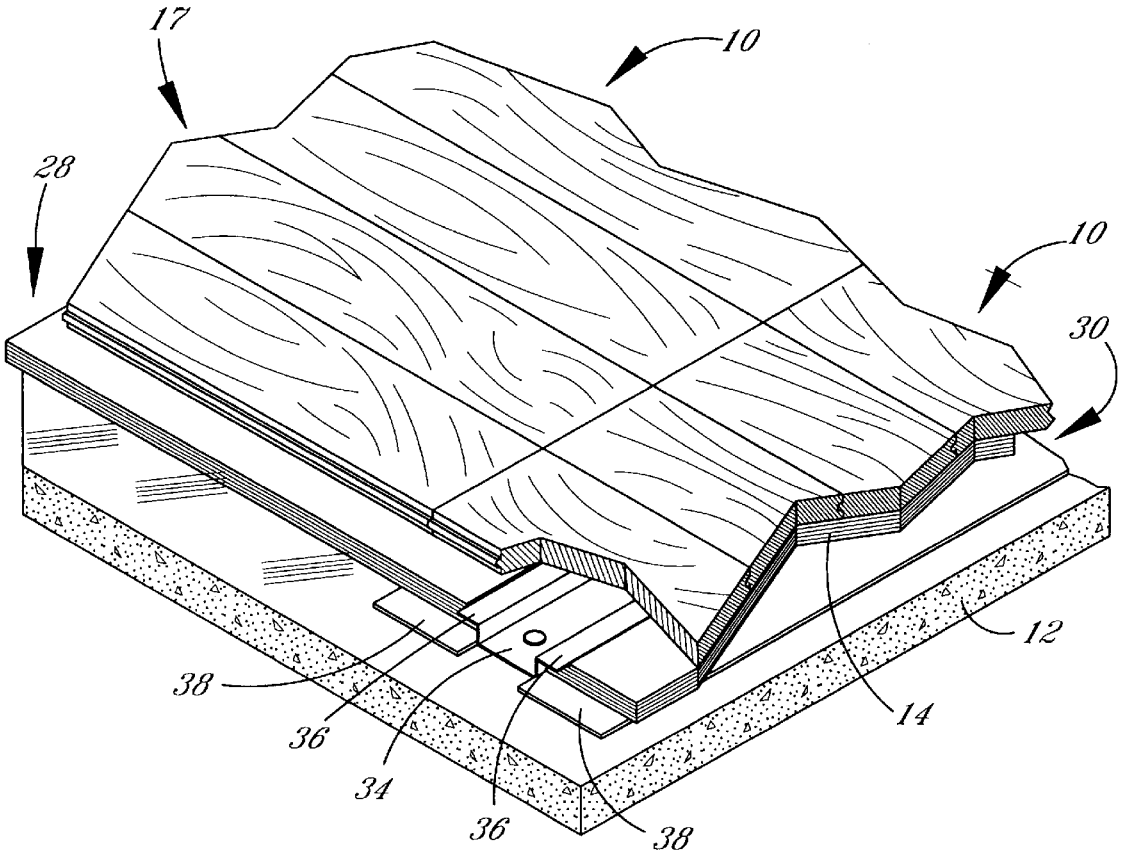
FIG. 3 is a sectional perspective view of a securing system for use with the flooring panels.
Figure 4:
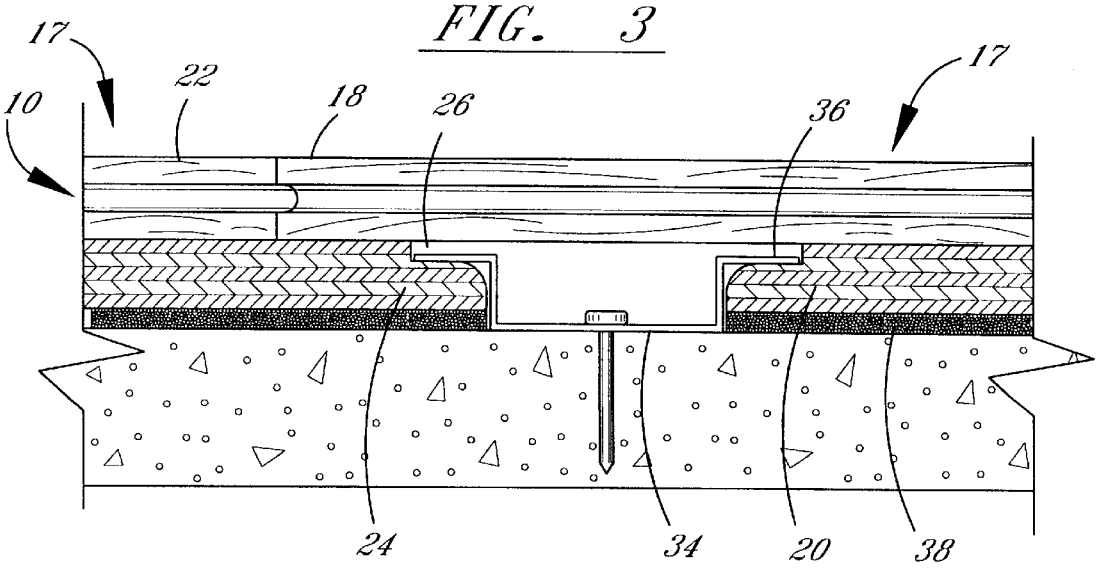
FIG. 4 is a sectional side view of the securing arrangement shown in FIG. 3.
Figure 5:
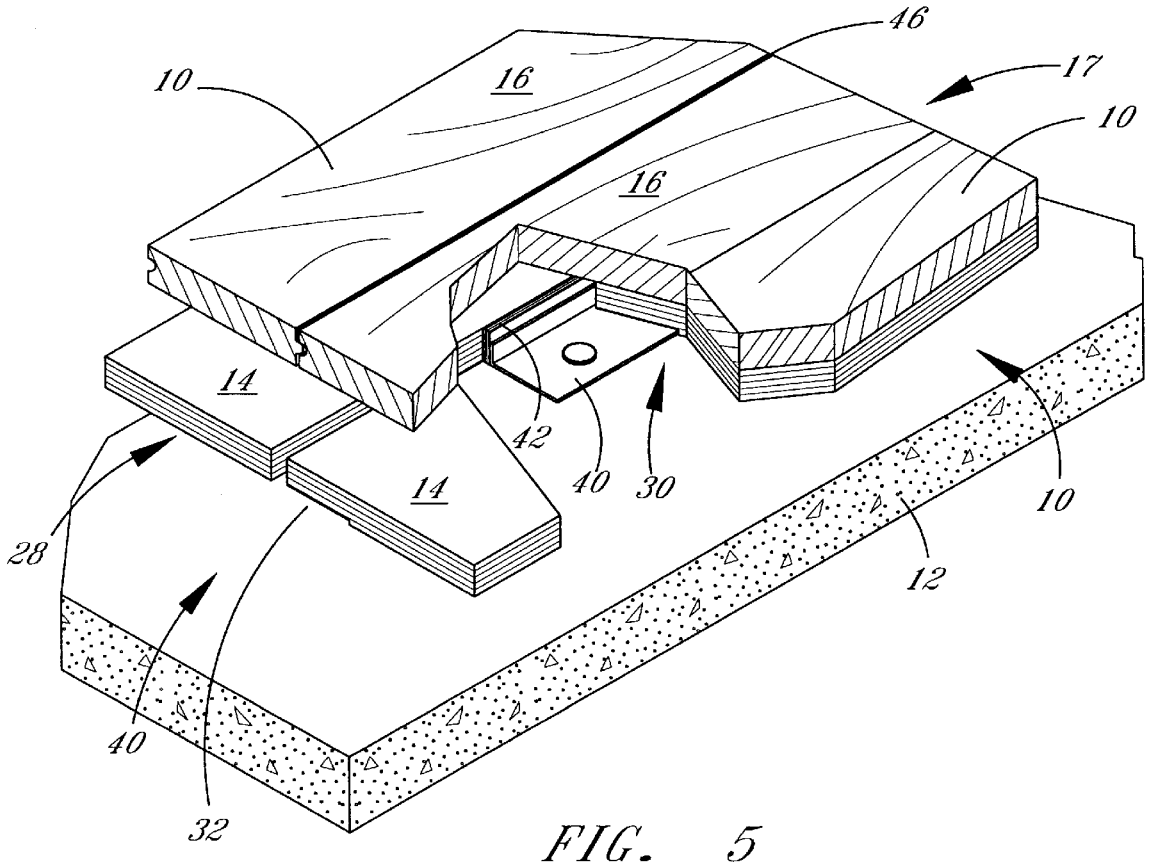
FIG. 5 is a perspective view of the side stabilizing system for use with the flooring system of the invention.
Figure 6:
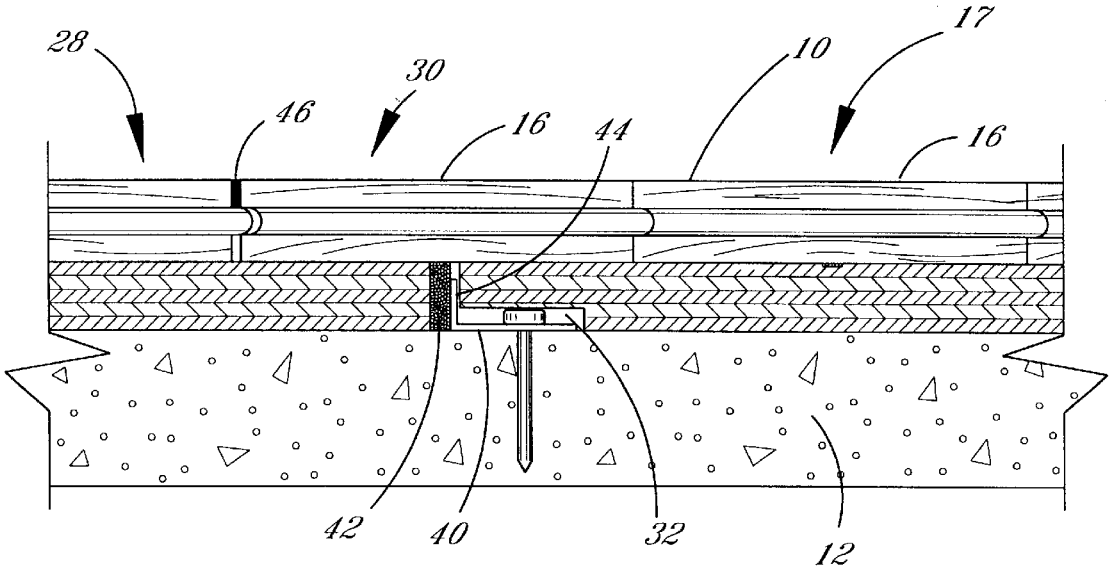
FIG. 6 is a side view of the stabilizing structure shown in FIG. 5.

Preferably, shorts 16 are formed tongue and groove and are intermeshed when forming flooring surface 17 of flooring panel 10 in a rectangular and slightly larger configuration than that of support layer 14. As seen in FIG. 4, first ends 18 of flooring surface 17 extends beyond first end 20 of the associated support surface 14 a selected distance of no more than 6". The opposite end of flooring panel 10 finds end 22 of flooring surface 17 recessed from the adjacent end 24 of support layer 14. A recessed shoulder 26 is formed across the upper surface of opposed ends 20, 24 of support surface 14. Outer ends of the shoulders may be planar or rounded to assist assembly of panels 10 with the fastening strips. Shoulders 26 are recessed up to ¼" below the flooring surface. Flooring surface 17 is also formed to extend beyond a first side of support layer 14 and to be recessed from the opposed side as shown at 28 and 30. A lower receiving ledge 32 is formed along one of the sides 28 or 30 as shown in FIGS. 5 and 6. Shorts 16 are arranged and secured across the support surface, as shown in FIGS. 1, 3 and 4, forming a first side 28 in which the lateral edge of the outermost short 16 is positioned away from the outer edge of support surface 14. Opposite side 30 is formed with the lateral edge of outermost short 16 overlying and extending beyond the outer edge of support surface 14. Opposed sides 18 and 30 are therefore formed with the vertical edge surface of support surface 14 offset from the vertical edge surface of flooring surface 17.

Figure 2A:
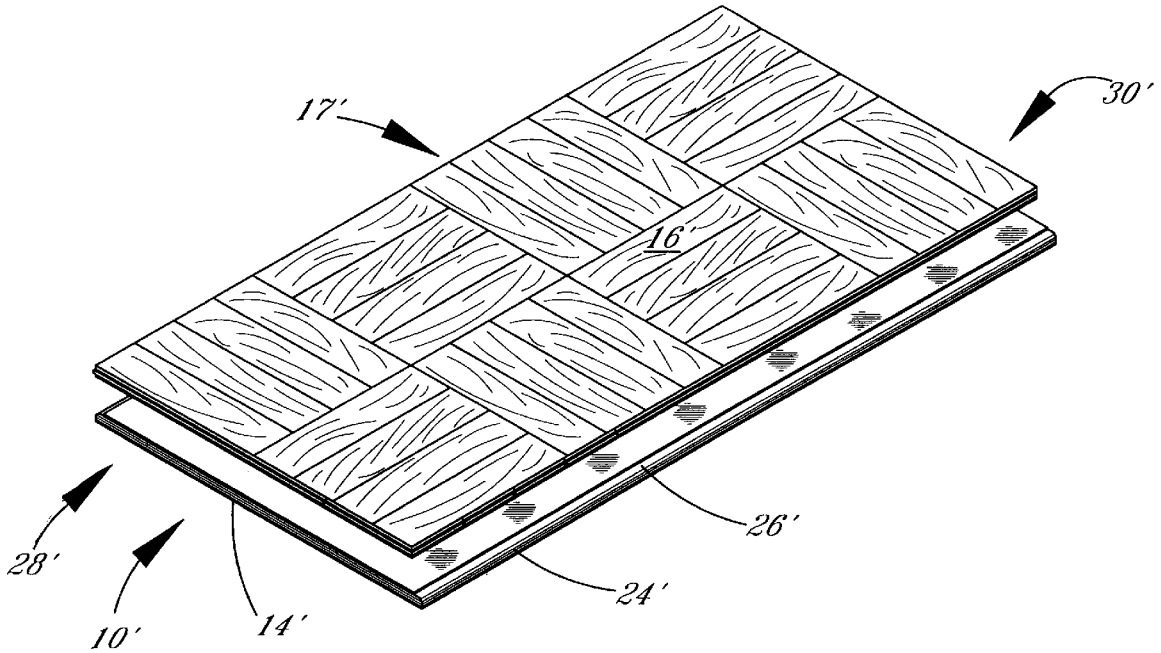
FIG. 2A is a perspective view of a flooring panel according to a second embodiment of the invention.

Turning now to FIG. 2A, an alternative arrangement of the flooring panel is identified as 10'. Flooring surface 17' is dimensioned and arranged relative to support surface 14' in the same manner as in FIG. 2. Support surface 14' is structured also as in FIG. 2.

In FIG. 2A, shorts 16' are arranged in squares, which are perpendicularly of each other, forming a parquet pattern over flooring surface 17'.

Figure 7:
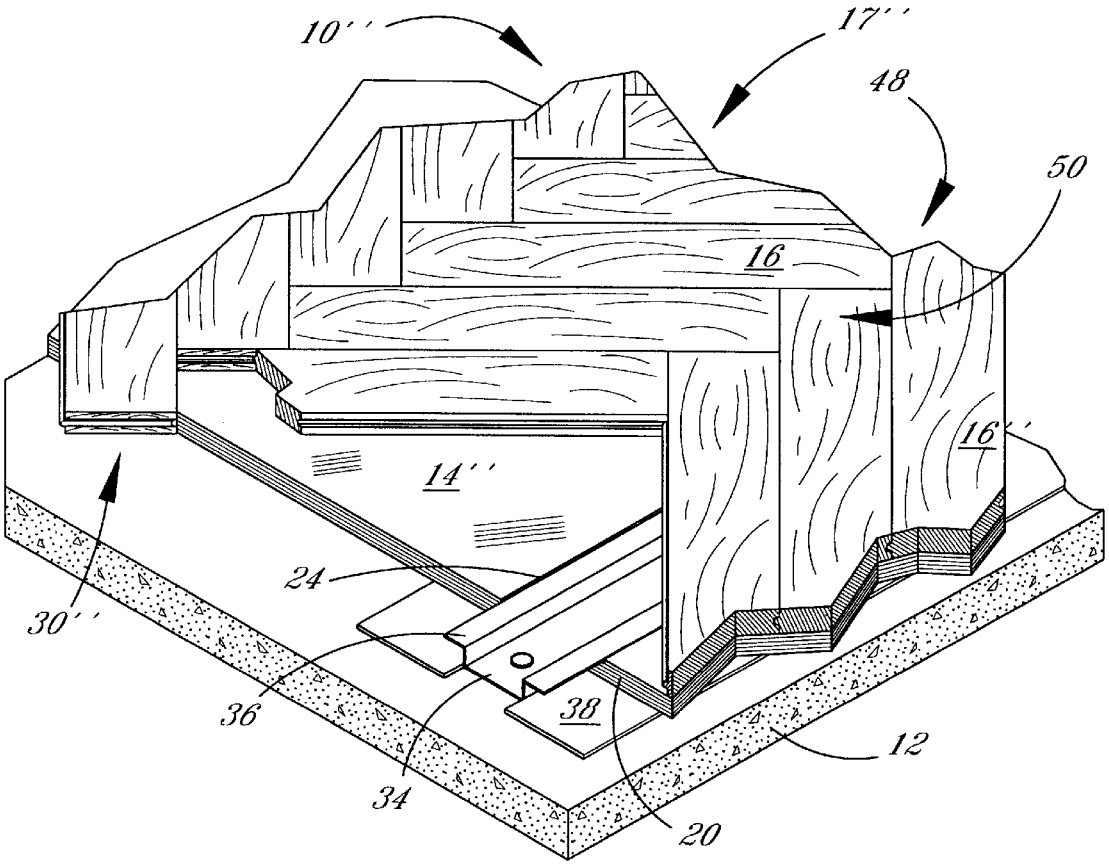
FIG. 7 is a sectional perspective view of the securing system of FIG. 3 securing flooring panels having the flooring arranged in a herringbone pattern.

A third arrangement or pattern for the flooring surface is shown in FIG. 7. Here shorts 16" are arranged in opposed diagonal rows forming a herringbone pattern over flooring surface 17" of flooring panel 10". Again support surface 14" is formed and arranged relative to the flooring surface as in FIG. 2.

Each of the flooring panels 10, 10' and 10" may be secured with base floor 12 with binding strips 34 as shown in FIGS. 3, 4, 7, and 8. Individual flooring panels of the three patterns are arranged relative to each other as shown in FIG. 1.

Turning again to FIGS. 3 and 4, the securing arrangement for positioning the panels forming the resilient flooring in place over base floor 12 is shown. The arrangement includes a plurality of longitudinal shaped fastening strips 34 secured in spaced longitudinal rows with the base floor. Each fastening strip 34 includes a pair of opposed transverse flanges 36. A resilient strip 38 is placed along side opposed sides of each fastening strip 34. Resilient strips 38 may be formed of rubber or of foam. The resilient strips are formed at approximately ¼" thick and 3" wide and provide the resilience of the resilient flooring system. If desired, a resilient layer could cover the entire base surface or more than two strips could be placed under each flooring panel.

After a row of fastening strips are positioned, ends 24 of flooring panels 10 are positioned under a first flange 36 and over resilient strip 38. Ledge 26 is of sufficient depth to allow limited vertical movement of the flooring panels by providing space for the panels to move relative to stationary flanges 36 whenever resilient strips 38 are compressed.

Flooring panels 10 are positioned with opposed sides 28 and 30 in side by side abutting positions. As shown in FIGS. 5 and 6 the panels are retained transversely stationary by spaced "L" shaped positioning strips 40 which are secured to base surface 12 transversely of and between adjacent fastening strips 34 at selected locations. A lower ledge 32 is formed along the lower surface and adjacent a side of selected flooring panels 10. Lower ledge 32 is adapted to receive a horizontal leg of positioning strip 40. A small resilient strip 42 is secured with one face of the vertical leg 44 of positioning strip 40. Another small resilient strip 46 is positioned between adjoining sides 28, 30 of flooring surfaces 17 of adjacent flooring panels 10. Strips 42, 46 allow slight lateral movement brought about by changes in size of flooring panels 10 due to expansion and contraction resulting from changes in humidity. Strips 42, 46 may also be located between adjoining ends if desired.

Ends 20 and 24 of support layer 14 are always formed planar in the transverse direction. Ends 18 and 22 of flooring surface 17 are normally formed planar as shown in the arrangements of FIGS. 2 and 2A. These ends are formed in a sawtooth arrangement in the herringbone pattern of FIGS. 7 and 8.

By providing that one of the adjoining ends 18 or 22 and adjoining sides 28 and 30 of flooring panels 10 always extends completely over fastening strips 34 and positioning strips 40 respectively, and by supporting these ends and sides on the upper surface of support layer 14 of the adjacent flooring panel 10, a uniformly stable flooring surface, which is absent of dead spots is provided.

Figure 8:
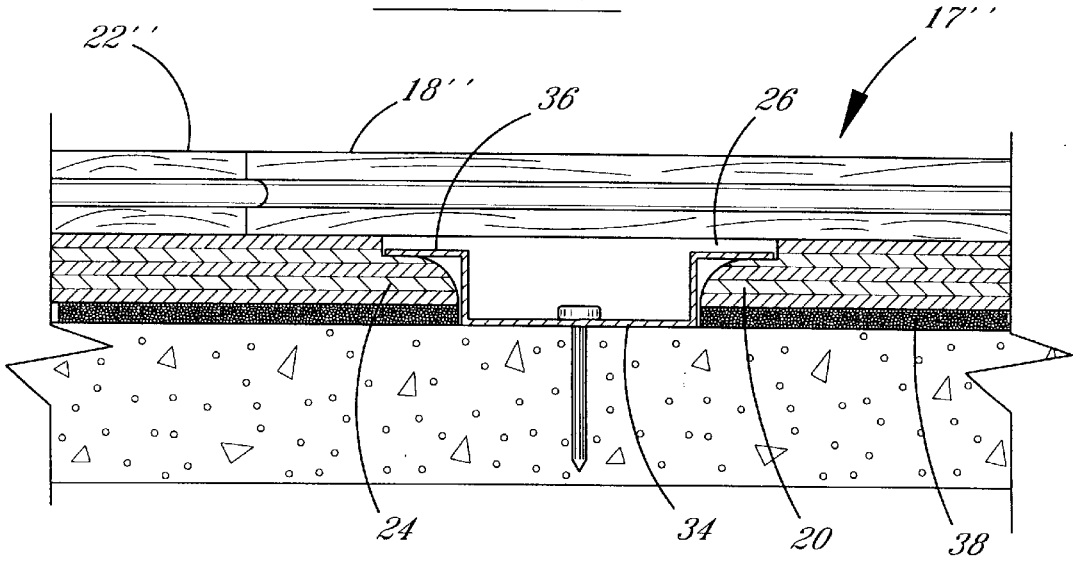
FIG. 8 is a sectional side view of the arrangement shown in FIG. 7.

The securing arrangement for securing flooring panels 10" with flooring surface 17" arranged in a herringbone pattern is shown in FIGS. 7 and 8. As earlier stated, shorts 16" forming flooring surface 17" are secured with support surface 14" in opposed diagonal rows creating a herringbone effect over the flooring surface. The arrangement of the flooring surface relative to the support surface 14" positions ends 18" and 22" creating over hangs and exposed areas exactly as described in the arrangements of in FIG. 2, 2A. However, due to the diagonal arrangement of the shorts ends 18" and 22" and edges 28" and 30" of the flooring surface 17" form a sawtooth pattern as shown at 50. The teeth of the sawtooth pattern intermesh, along the line indicated at 48, in the manner described in FIGS. 3 and 4 forming a continuous flooring surface.

The resilient flooring assembly utilizing the flooring panels and the securing assemblies of all of the embodiments shown in FIGS. 3–8 are designed of easy assembly and disassembly.

While preferred embodiments of the invention have been described using specific terms, such description is for illustrative purposes only, and it is to be understood that changes and variations may be made without departing from the spirit or scope of the following claims.

What is claimed is:

1. A multi-layer planar section having utility in resilient flooring systems comprising:

a unitary and substantially rigid support layer;

an upper layer having dimensions larger than the dimensions of said lower layers, said upper layer formed of a plurality of shorts arranged over and secured with an upper surface of said support layer, said shorts being arranged to extend beyond a first end of said support layer and short of a second end of said support layer;

a recessed ledge formed in said upper surface of said support layer along said first and second ends, said ledge in said first end of said support layer being located between said support layer and said upper layer and said ledge in said second end of said support layer being exposed; whereby ends of said upper layer overlap ends of said support layer when said sections are positioned in said flooring system.

2. The planar section of claim 1 wherein said support layer comprises a unitary plywood sheet and said upper layer comprises a plurality of hardwood shorts of varying lengths.

3. The planar section of claim 2 wherein said shorts are secured with said plywood sheets by gluing.

4. The planar section of claim 1 wherein said planar section includes opposed sides, said opposed sides having offset vertical surfaces.

5. The planar section of claim 1 wherein said first and second ends comprise offset vertical surfaces.

6. The planar section of claim 1 wherein said support layer comprises a ¾" plywood sheet and said shorts of said upper layer comprise a plurality of hardwood boards of between ½' to 4' in length and ¾" to 1" in thickness.

7. The planar section of claim 6 wherein said shorts are formed tongue and groove and are interfitted when forming said upper layer.

8. The planar section of claim 2 wherein said shorts are arranged to extend longitudinally of said plywood sheet.

9. The planar section of claim 2 wherein said shorts are arranged to extend diagonally of said plywood sheet in a herringbone pattern.

10. A multi-layer planar flooring section for flooring systems comprising:

a unitary and substantially rigid support layer formed of wood-like material;

an upper layer formed of a plurality of inter-engaged wooden shorts arranged over and secured with an upper surface of said support layer, said shorts being arranged to extend beyond a first end of said support layer and short of a second end of said support layer;

a recessed ledge formed in said upper surface of said support layer along said first and second ends, said ledge along said first end being covered by a lower surface of said shorts secured to said upper surface of said support layer forming said upper layer and said ledge in said second end being uncovered and exposed; whereby, ends of said shorts forming said upper layer overlap exposed ends of said support layer when said sections are utilized in said flooring system.

11. The resilient flooring systems of claim 10 wherein said resilient material comprises at least a pair of resilient strips arranged along each side of said fastening strips.

12. The planar section of claim 10 wherein the dimensions of said upper layer are larger than those of said lower layer.

13. The resilient flooring of claim 10 wherein an edge of said flooring layer at one of said ends of said planar section extends beyond a corresponding edge of said support layer.

14. The resilient flooring of claim 10 wherein an edge said support layer at one of said ends of said planar section extends beyond an edge of said flooring layer.

15. The resilient flooring of claim 10 wherein the rectangular dimension of said flooring layer is larger than the rectangular dimension of said support layer.

16. The resilient flooring of claim 10 wherein said flooring layer of said planar sections comprise a plurality of hardwood shorts and said support layer comprises a unitary plywood panel, said shorts being fixedly secured with said plywood panel.

17. The resilient flooring of claim 16 wherein said shorts are arranged diagonally of said plywood panel, forming a herring bone pattern.

18. The resilient flooring of claim 16 wherein said shorts are formed tongue and groove and are intermeshed when secured with said plywood panel.

19. The resilient flooring of claim 16 wherein said shorts are arranged longitudinally of said plywood panel.

20. The resilient flooring of claim 10 wherein an edge of said flooring layer at one of said sides extends beyond a corresponding edge of said support layer.

21. The resilient flooring of claim 20 including positioning strips arranged at spaced intervals and secured with said base surface, said positioning strips engaging selected edges of said support layer at selected sides of said planar sections for limiting lateral movement of said planar sections in said flooring system.

22. The resilient flooring of claim 21 including a resilient strip secured with at least one of said edges of said flooring layer and said support layer at said selected sides.

* * * * *